US006132299A

United States Patent [19]

Tasikas

[11] Patent Number: 6,132,299

[45] Date of Patent: Oct. 17, 2000

[54] LINEAR SANDER

[76] Inventor: James Nil Tasikas, 84 Northline Rd., Toronto, Canada, M4B 3E5

[21] Appl. No.: 09/294,666

[22] Filed: Apr. 19, 1999

[51] Int. Cl.[7] ..... B24B 23/04

[52] U.S. Cl. ..... 451/356; 451/351; 451/344; 451/355; 451/359; 451/357; 451/162

[58] Field of Search ..... 451/351, 356, 451/162, 344, 353, 357, 359

[56] References Cited

U.S. PATENT DOCUMENTS

| | | | |
|---|---|---|---|
| 1,099,617 | 6/1914 | Reed | 451/351 |
| 1,122,233 | 12/1914 | Smith | 451/351 |
| 1,635,480 | 7/1927 | Jacobson | 451/351 |
| 2,620,775 | 12/1952 | Champayne | 451/351 |
| 3,148,487 | 9/1964 | Fildes | 451/351 |
| 5,716,263 | 2/1998 | Jones et al. | 451/356 |

FOREIGN PATENT DOCUMENTS

| | | | |
|---|---|---|---|
| 8904 | 1/1928 | Australia | 451/356 |

*Primary Examiner*—David A. Scherbel
*Assistant Examiner*—George Nguyen

[57] ABSTRACT

A linear sanding apparatus, for providing a linear reciprocating sanding action, and having a support assembly, a drive shaft, and having a angled drive plate on the shaft, and a motor for rotating the shaft, two transmission devices coupled to the drive plate, and operable by rotation of the drive plate, to reciprocate along linear paths in opposite directions side by side to one another, and first and second sanding plates connected to respective transmission devices, and movable in unison with movement of the devices to and fro, side by side to one another along reciprocating linear parallel paths in opposite directions.

13 Claims, 3 Drawing Sheets

LINEAR SANDER

FIELD OF THE INVENTION

The invention relates to a sanding machine and in particular to a sanding machine providing a reciprocating linear action, and in which there are two sanding plates, which move in opposite linear directions simultaneously.

BACKGROUND OF THE INVENTION

Sanding machines having a variety of different actions are available. For example, a simple disc sander rotates a sanding disc on the surface of a work piece. Drum sanders rotate a cylindrical drum supporting a strip of sandpaper. Belt sanders drive a sanding belt around a predetermined path, and produce an action similar to a drum sander. Orbital sanders are available which provide a flat plate on which a sheet of sandpaper is supported, with a plate being rapidly moved around an orbital path on a work piece. All of these different sanding machines have attendant disadvantages. Disc sanders are difficult to control, and have a tendency to gouge a work piece surface, and produce uneven results. The sanding discs break down rapidly. Drum sanders and belt sanders are usually used for hardwood floor surfaces. They too have disadvantages in that they produce only a line contact (i.e. tangent to the drum,) between the sanding sheet and the surface, and again they tend to produce uneven results, especially where there are variations in the grain of the wood. Orbital sanders are in wide use by hobbyists. However, these sanders are usually hand held appliances, and produce a fairly strong vibration. Consequently they are not suitable for extended use.

When sanding it is desirable to provide a linear to and fro action, and to provide a sanding action extending over a significant surface area so that the sanding action will be uniform over the whole area of the work piece. At the same time, it is desirable to provide such a linear action sander in which vibration is substantially eliminated, so that it, and, if needed, hand held, may be used for extended periods of time without causing health problems.

However, a single plate linear movement sander would experience severe vibration problems, which would be greater than the vibration problems inherent in the orbital type of plate sander. Consequently such a system would be impractical.

BRIEF SUMMARY OF THE INVENTION

With a view to overcoming many of the problems described above in relation to sanding machines, the invention comprises a linear sanding apparatus, for providing a linear reciprocating sanding action on a work piece surface, and comprising a support assembly, a drive shaft supported within said assembly, and having a angled drive plate on the shaft, and a power operated means for rotating the shaft, at least two transmission devices coupled to said drive plate, and operable by rotation of said drive plate, to reciprocate along linear paths in opposite directions side by side to one another, and first and second sanding plates connected to respective said transmission devices, movable in unison with movement of said transmission devices to and fro, side by side to one another along reciprocating linear parallel paths in opposite directions.

In a preferred form of the invention the support assembly comprises a plurality of spaced apart support panels, and transmission devices extending between the panels, the panels defining bearings for receiving the drive shaft and the devices.

In this embodiment, there are preferably four such panels, mounted spaced apart from one another along a common central axis.

In this form of the invention, the four panels comprise first and second end panels, and third and fourth intermediate panels, with the angled drive plate located between the third and fourth intermediate panels.

In this form of the invention, panel connecting means are provided on respected devices, inter-engagable with the drive plate.

The invention further provides a housing for the support assembly, and a drive motor enclosed in the housing, and guide means connected to the housing whereby the sanding machine may be guided manually.

Preferably, the drive shaft will be supported in bearings mounted in the third and fourth intermediate panels and will extend through one of the first or second end panels, for engagement with suitable drive transmission means.

Preferably, in this type of apparatus, each of the two sanding panels will be provided with two spaced apart abrasive mounting pads, so that sheets of abrasive material may be mounted on respective pads in spaced apart locations, so as to provide a level even sanding function on a surface.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 2:
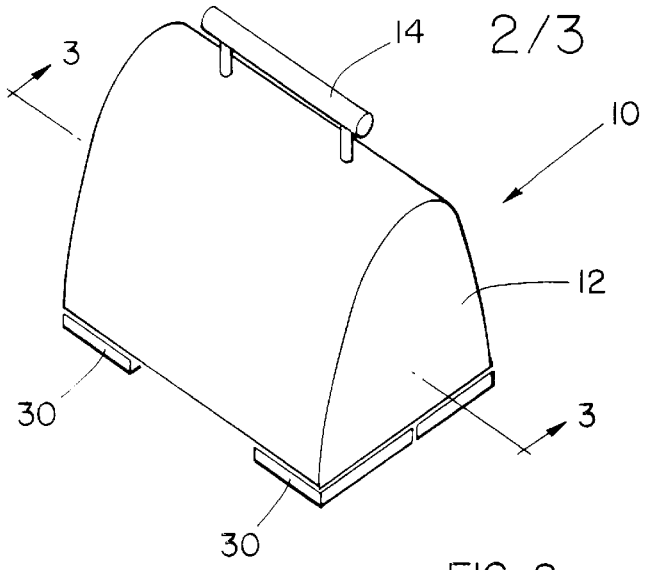
FIG. 2 is a schematic perspective illustration of the sanding machine shown with the housing.

Referring first of all to FIG. 2, it will be seen that what is illustrated there, for the purposes of illustrating the invention, is a hand held sanding apparatus indicated generally as 10.

The apparatus 10 comprises a housing 12, with a handle 14 on top of the housing, by means of which the apparatus may be applied to a surface of a work piece.

Figure 1:
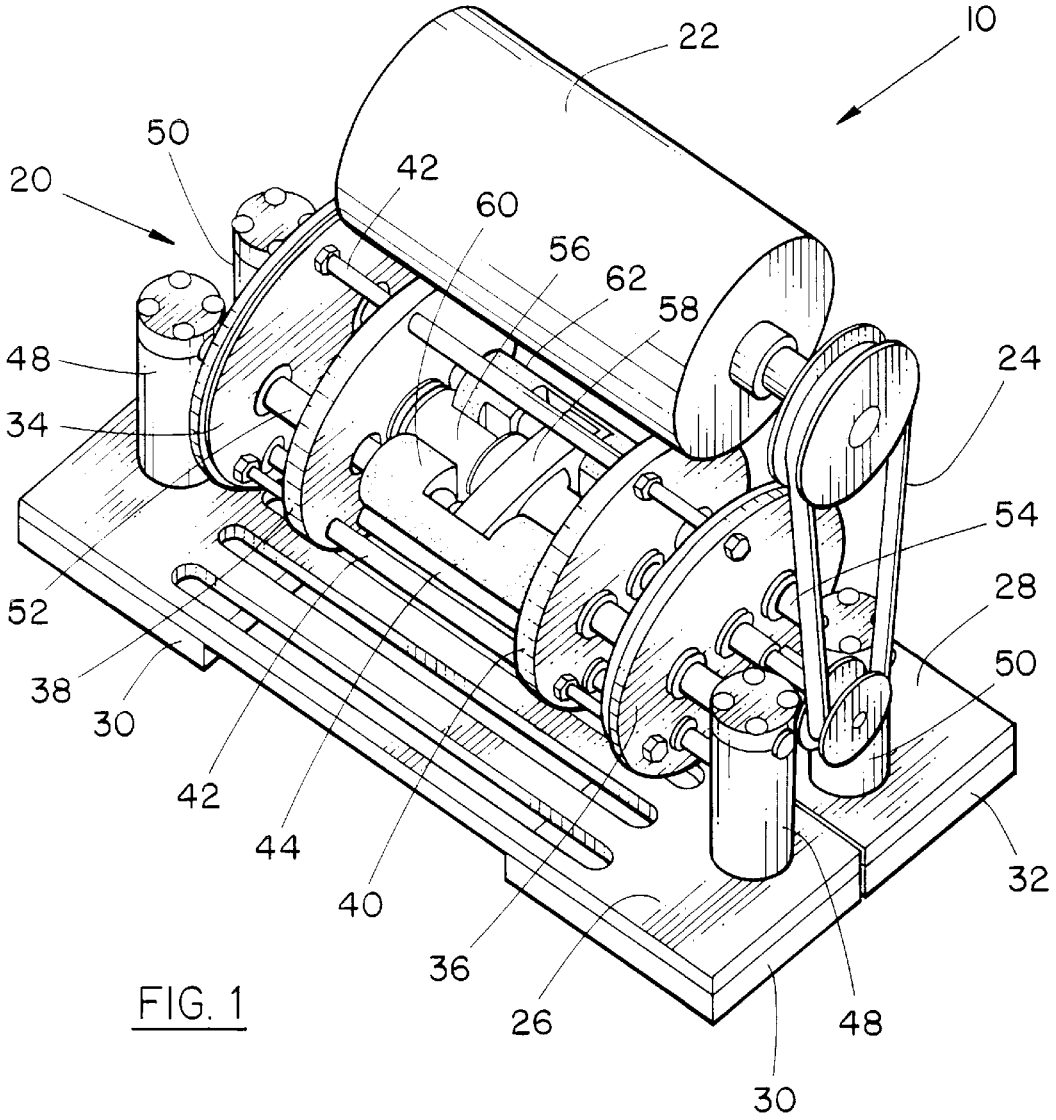
FIG. 1 is a perspected illustration of a linear sanding machine illustrating one embodiment of the invention, (without a housing)
Figure 3:
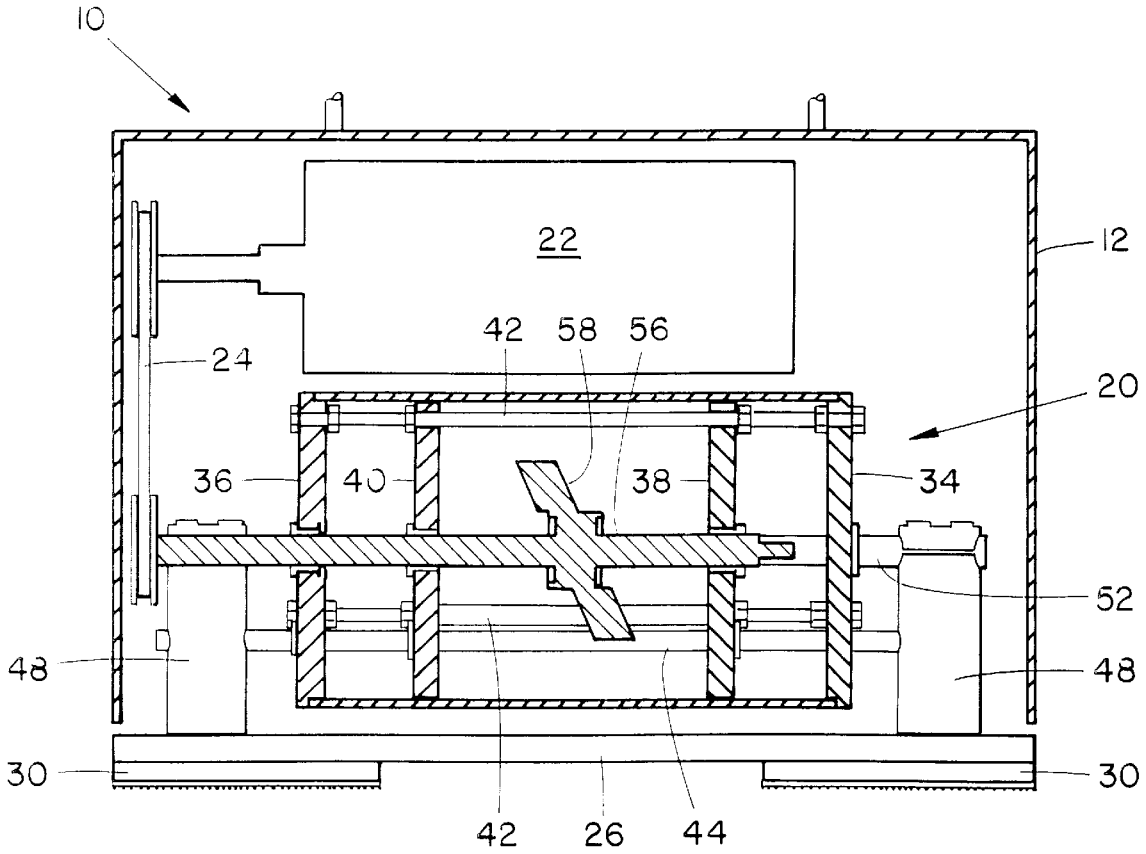
FIG. 3 is a sectional side elevation along the line of 3—3 of FIG. 2.
Figure 4:
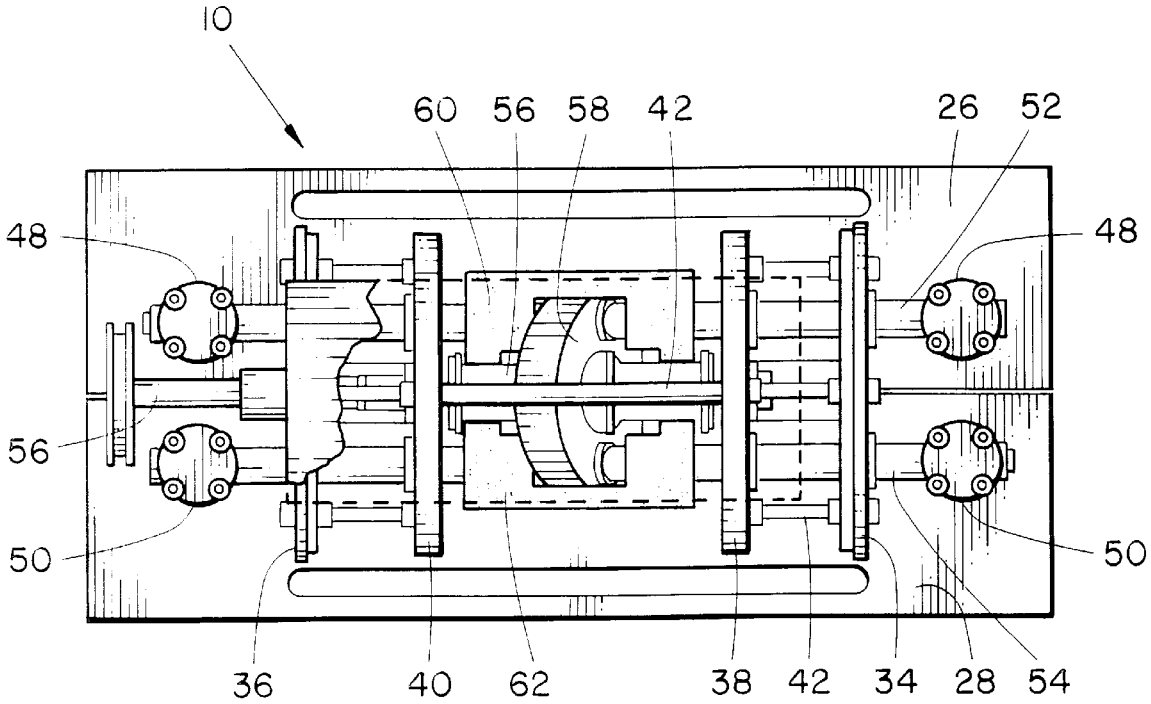
FIG. 4 is a top plan view of the apparatus shown in FIG. 1.

Within the housing (FIGS. 1, 3 and 4) there is a support assembly indicated generally as 20, and a drive motor 22 connected to the support assembly by means of, for example, a belt drive 24.

Extending below the housing, are a pair of linear sanding plates 26 and 28. Plates have located on their underside, typical hook and pile fastening pads 30 and 32 at opposite ends spaced apart from one another, with a gap in between.

Figure 5:
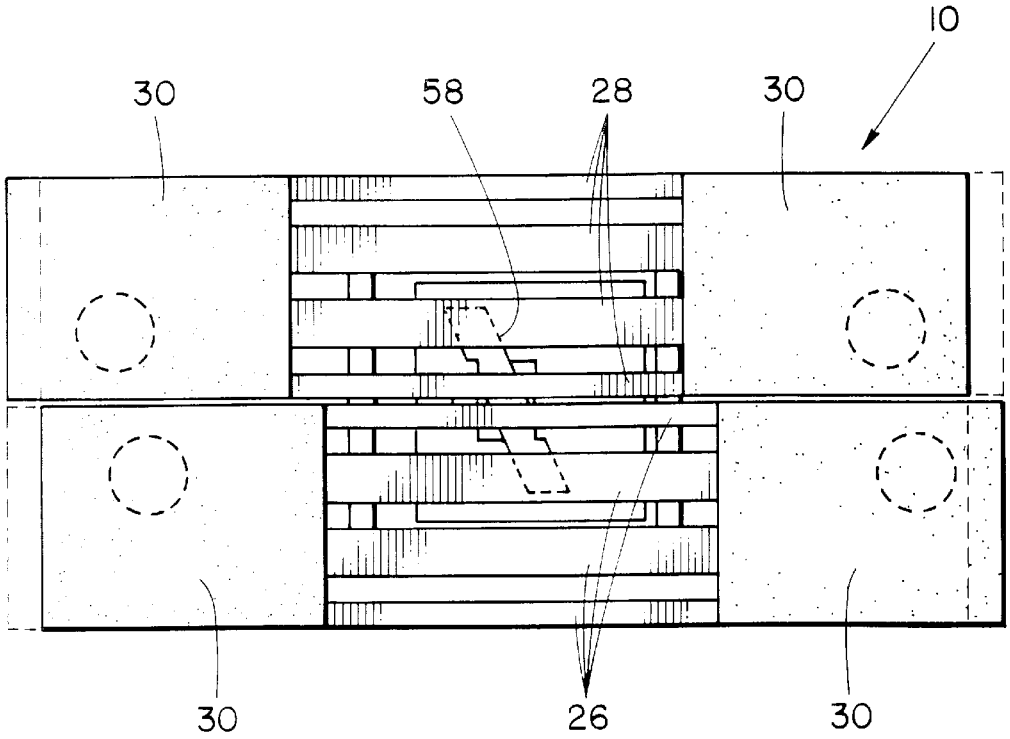
FIG. 5 is a schematic bottom plan showing movement in phantom.

Plates 26 and 28 are formed as parallel bars (FIG. 5) devices spaced apart openings, in order to reduce mass, and thus reduce vibration, in use.

The pads 30–32 are adapted to receive sheets (not shown) of sanding or other abrasive material having a complementary hook and pile upper surface (not shown) of a type well known in the art. Such hook and pile backed sanding sheets are well known, and may simply be applied to the pads 30 and 32 in known manner by inter engagement of hook and pile fastenings. Typical hook and pile fastenings are for example "Velcro" (trade-mark) material.

The support assembly 20 comprises respective end panels 34 and 36, and respective intermediate panels 38 and 40. The end panels 34–36 and intermediate panels 38–40 are arranged in spaced apart pairs, for reasons to be described below.

The end panels 34–36 and intermediate panels 38–40 are firmly connected to one another by means of three identical tie devices 42, which are typically secured to respective end plates and intermediate plates by nuts or other threaded fastenings.

Extending through suitable openings defined in the two end plates 34–36 and two intermediate plates 38–40, there are two parallel spaced apart plate guide rods 44 and 46. The guide rods 44 and 46 are slidable relative to the end plates 34–36 and intermediate plates 38–40 so as to and fro through the end plates and intermediate plates.

The guide rods 44–46 extend out of the end panels 34–36 at either end, and connect with mounting posts 48 and 50. Posts 48 and 50 are secured at opposite ends of the linear sanding panels 26 and 28.

In this way, the sanding plates 26 and 28 are moveably supported for axial linear movement relative to the end panels 34–36 and intermediate panels 38–40.

In order to transmit power movement to the sanding plates 26 and 28 means comprising in this case, respective transmission devices, namely transmission rods, 52 and 54 are provided. Devices 52 and 54 extend completely through the end panels 34–36 and intermediate panels 38–40, through suitable slide bearings or openings and are slideable to and fro relative to the end and intermediate panels. The transmission devices 52–54 are spaced from the guide rods 44–46, and extend outwardly from either end panels 34–36, and are connected to the posts 48 and 50. In this way the posts 48 and 50 are securely held by the spaced apart location of the guide rods 44–46 and the transmission devices 52–54, relative to the end panels 34–36 and intermediate panels 38–40.

In order to transmit linear axial movement to the respective transmission rods 52–54, a central rotary drive shaft 56 is provided which extends through the two intermediate panels 38 and 40, and through one of the end panels 36. Shaft 56 is connected by means of a suitable pulley to the drive belt 24 (FIG. 1) and drive motor 22. In this way the drive shaft 56 can be rotated relative to the end panels 34–36 and intermediate panels 38–40.

Drive is transmitted from the drive shaft 56 to the transmission devices, 52–54 by means of the diagonally mounted swash plate 58. Swash plate 58 rides in drive connecting means, namely, yokes 60 and 62 on respective transmission rods 52 and 54. Suitable ball bearings are provided within the yokes 60–62, for engaging the opposite sides of the swash plate 58 in known manner. It will now be seen that by rotating the drive shaft 56, the swash plate 58 will move one of the yokes 60 in one direction, and the other of the yokes 62 in the opposite direction. This will be transmitted to the respective sanding plates 26 and 28 as linear movement, so that the sanding plates reciprocate along side each other, side by side on parallel axes (as shown in phantom in FIG. 5). In this way the sanding plates 26 and 28 will reciprocate to and fro in opposite directions. Since the drive mechanism is achieved through the means of a swash plate 58, the movement of the sanding plates 26–28 is progressive and continuous in their opposite directions, so that vibration is minimized, thereby enabling a service person to hold and to handle the machine for extended periods of time without physical discomfort.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A linear sanding apparatus, for providing a linear reciprocating sanding action, and comprising;

a support assembly having a plurality of spaced apart support panels, and rods extending between the panels;

a drive shaft supported within said assembly;

an angled drive plate on the shaft, and a power operated means for rotating the shaft;

two transmission devices coupled to said drive plate, and operable by rotation of said drive plate, to reciprocate along linear paths in opposite directions side by side to one another, and, wherein the panels define bearings for receiving the drive shaft and the transmission devices; and, first and second sanding plates connected to respective said transmission devices, and movable in unison with movement of said devices to and fro, side by side to one another along reciprocating linear parallel paths in opposite directions.

2. A linear sander as claimed in claim 1 wherein there are preferably four such support panels, mounted spaced apart from one another along a common central axis.

3. A linear sander as claimed in claim 2 and wherein the four support panels comprise first and second end panels, and third and fourth intermediate panels.

4. A linear sander as claimed in claim 3 wherein the angled drive plate is located between the third and fourth intermediate panels.

5. A linear sander as claimed in claim 3 and wherein drive plate engaging means are provided on respected transmission devices, inter-connecting with the drive plate.

6. A linear sander as claimed in claim 1 and including a housing for the support assembly, and a drive motor enclosed in the housing, and manual guide means on said housing for grasping by the hand whereby the linear sanding apparatus may be manually held and may be guided manually.

7. A linear sander as claimed in claim 6 and wherein the drive shaft is supported in bearings mounted in the third and fourth intermediate panels and extends through one of the first or second end panels, for engagement with suitable drive transmission means.

8. A linear sander as claimed in claim 7 and wherein each of the two sanding plates are provided with two spaced apart abrasive mounting pads, so that sheets of abrasive material may be mounted on respective pads in spaced apart locations, so as to provide a level even sanding function on a work piece surface.

9. A linear sander as claimed in claim 1 and further including guide rods extending between said spaced apart support panels, said guide rods being slidable to and fro relative to said support panels, and mounting means connecting said guide rods to said sanding plates.

10. A linear sanding apparatus as claimed in claim 9 and wherein there are two such mounting means on each of said respective sanding plates, and wherein said two transmission devices are connected at either end to respective said mounting means on respective said sanding plates, said transmission devices being mounted in spaced location parallel to and spaced apart from said guide rods.

11. A linear sanding apparatus as claimed in claim 1 wherein said transmission devices comprise spaced apart parallel transmission rods mounted in bearings and slidable to and from in opposite directions.

12. A linear sanding apparatus, for providing a linear reciprocating sanding action, and comprising;

a support assembly having means defining spaced apart openings;

a drive shaft supported within said assembly;

drive means on the shaft, and a power operated means for rotating the shaft;

transmission means coupled to said drive means, and operable by rotation of said drive means, to reciprocate along linear paths in opposite directions;

guide rods extending through said openings in said support assembly, and being slidable through said openings relative to said assembly; and, first and second sanding plates connected to said transmission means, to said guide rods, and said sanding plates being movable in unison with movement of said transmission means to and fro, side by side to one another along reciprocating linear parallel paths in opposite directions, with said guide rods moving to and fro through said openings.

13. A linear sanding apparatus, for providing a linear reciprocating sanding action, and comprising;

a support assembly;

a drive shaft supported within said assembly;

drive means on the shaft, and a power operated means for rotating the shaft;

transmission rods coupled to said drive means, and operable by rotation of said drive means, to reciprocate along linear paths in opposite directions;

openings in said support assembly, through which said transmission rods extend said transmission rods being moveable through said openings relative to said assembly; and, first and second sanding plates connected to said transmission rods, and said sanding plates being movable in unison with movement of said transmission rods to and fro, side by side to one another along reciprocating linear parallel paths in opposite directions.

* * * * *